United States Patent [19]

Fujimori et al.

[11] Patent Number: 4,920,942

[45] Date of Patent: May 1, 1990

[54] METHOD AND APPARATUS FOR SUPPLYING FUEL TO INTERNAL COMBUSTION ENGINES

[75] Inventors: Kyoichi Fujimori; Masaki Sano, both of Higashimatsuyama, Japan

[73] Assignee: Diesel Kiki Co., Ltd., Tokyo, Japan

[21] Appl. No.: 183,127

[22] Filed: Apr. 19, 1988

[30] Foreign Application Priority Data

Apr. 24, 1987 [JP] Japan ..... 62-99911
Apr. 24, 1987 [JP] Japan ..... 62-99912
Sep. 25, 1987 [JP] Japan ..... 62-145347[U]

[51] Int. Cl.[5] ..... F02M 39/00
[52] U.S. Cl. ..... 123/497; 123/494
[58] Field of Search ..... 123/497, 458, 499, 456, 123/494, 357–359

[56] References Cited

U.S. PATENT DOCUMENTS 3,822,677 7/1974 Reddy ..... 123/497
3,913,547 10/1975 Wentworth ..... 123/497
3,935,851 2/1976 Wright ..... 123/497
3,967,598 7/1976 Rachel ..... 123/497
4,112,901 9/1978 Chapin ..... 123/497
4,125,093 11/1978 Platzer ..... 123/497
4,205,648 6/1980 Graham ..... 123/497
4,248,194 2/1981 Drutchas et al. ..... 123/497

*Primary Examiner*—Carl Stuart Miller
*Attorney, Agent, or Firm*—Pollock, Vande Sande & Priddy

[57] ABSTRACT

For supplying fuel from a fuel tank to an internal combustion engine by a fuel supply pump, a fuel delivery pressure of the fuel supply pump is regulated by a pressure regulating valve so as to maintain the difference between the fuel delivery pressure of the pump and an inner pressure of an intake manifold of the engine at a prescribed constant value, and the delivery volume of fuel from the pump is controlled in response to the fuel delivery pressure so as to minimize the amount of surplus fuel produced by the pressure regulating operation of the pressure regulating valve.

12 Claims, 4 Drawing Sheets

FIG. 9C $\overline{PS'}$

METHOD AND APPARATUS FOR SUPPLYING FUEL TO INTERNAL COMBUSTION ENGINES

BACKGROUND OF THE INVENTION

1. Field of the Invention

The present invention relates to a method and apparatus for supplying fuel to internal combustion engines.

2. Description of the prior art

There is known in the prior art a fuel supply apparatus having a fuel supply pump driven by an electric motor, in which, after fuel pressurized by the fuel supply pump is regulated in pressure by means of a pressure regulating valve in relation to the internal pressure of an intake manifold of an internal combustion engine, a required amount of the pressure-regulated fuel is injected into cylinders of the internal combustion engine by the use of fuel injectors. In the above-described conventional fuel supplying apparatus the fuel supply pump always operates at its upper limit speed and the amount of surplus fuel produced by the regulating operation of the pressure regulating valve varies depending upon the engine load. As a result, a large amount of surplus fuel returns through a return passage from the pressure regulating valve to a fuel tank when the engine load is small, whereas a smaller amount of surplus fuel returns by the same route when the engine load is large.

As described above, since the fuel supply pump of the conventional fuel supply system always operates at its upper limit speed, the noise level and energy consumption of the fuel supply pump are large. Furthermore, the surplus fuel returns to the fuel tank through a long return passage provided between the engine and the fuel tank, in most cases causing a large increase in the temperature of fuel. Thus, in the case where the fuel supply pump always operates at its maximum capacity, the surplus fuel quantity cannot be reduced and increase of fuel temperature is promoted. Returning this high temperature fuel to the fuel supply pump may cause the fuel supply pump or the fuel injectors to vapor lock. As a result, the supply of fuel may become impossible.

Moreover, there may be cases where no fuel is supplied from the fuel injectors, as when, for the example, the supply of fuel is cut during deceleration, at the time of engine failure or the like at such times, all of the pressurized fuel supplied from the fuel supply pump will return to the fuel tank. This means that all of the energy used for driving the fuel supply pump is wasted and may result in a pronounced increase in the temperature of the fuel in the fuel tank.

SUMMARY OF THE INVENTION

It is an object of the present invention to provide an improved method and apparatus for supplying fuel to internal combustion engines, which are capable of eliminating the above-mentioned disadvantages of the prior art.

It is another object of the present invention to provide a fuel supplying method and apparatus for internal combustion engines, which are capable of effectively suppressing the amount of surplus fuel produced by a fuel-pressure regulating operation.

It is a further object of the present invention to provide a fuel supplying apparatus using a fuel supply pump, which is capable of reducing the amount of surplus fuel produced by a fuel-pressure regulating operation.

According to one aspect of the present invention, in a fuel supplying method for supplying fuel from a fuel tank to an internal combustion engine by means of a fuel supply pump, the method comprises steps of regulating the pressure of fuel pressurized and supplied by the fuel supply pump by means of a pressure regulating member so as to maintain the difference between the output fuel pressure of the pump and an inner pressure of an intake manifold of the engine at a prescribed constant value, and controlling the delivery volume of fuel from the fuel supply pump in response to the output fuel pressure so as to minimize the amount of surplus fuel produced by the pressure regulating operation of the pressure regulating member.

Since the output pressure of the fuel supply pump is maintained by the pressure regulating member so as to be always larger than the intake pressure of the engine by the prescribed constant value, when the inner pressure of the intake manifold varies due to change in engine load, the fuel pressure at the outlet of the fuel supply pump will be changed at the same time in correspondence with the change in the inner pressure. That is, the pressure of fuel supplied from the pump is adjusted depending upon the engine load by the abovementioned regulating operation of the pressure regulating member, and the quantity of fuel delivered by the pump is regulated depending upon its fuel supply pressure in such a way that the engine is supplied with the appropriate amount of fuel for its load. Thus, the amount of returned fuel can always be minimized.

According to another aspect of the present invention, in an apparatus for supplying fuel to an internal combustion engine, the apparatus has a fuel supply pump for pressurizing fuel from a fuel tank, a pressure regulating member for regulating the pressure of fuel supplied from the fuel supply pump so as to be always larger than an inner pressure of an intake manifold of the engine by a prescribed constant amount, a fuel injecting member for injecting the pressure-regulated fuel from the pressure regulating member into the engine, a detecting means for electrically detecting the pressure of the fuel from the fuel supply pump, and a controlling means responsive to the detecting means for controlling the amount of fuel delivered by the fuel supply pump so as to minimize the amount of surplus fuel produced by the pressure regulating operation of the pressure regulating member.

If the inner pressure of the intake manifold varies due to change in the engine load, the pressure of fuel delivered by the pump will change in accordance with the change in the inner pressure. That is, the pressure of the fuel supplied to the fuel injector is adjusted depending upon the engine load by the abovementioned regulating operation of the pressure regulating member. The pressure of the fuel at the outlet side of the fuel supply pump is detected by the detecting means. The amount of fuel delivered by the pump is regulated in response to at least the output of the detecting means, in such a way that an adequate amount of fuel for the engine load can be supplied to the engine.

Thus, the amount of surplus fuel from the pressure regulating member can be constantly minimized. The detecting means and the control means can be incorporated into the fuel supply pump.

According to a further aspect of the present invention, in a fuel supplying apparatus in which fuel is supplied from a fuel tank to an internal combustion engine by means of a fuel injecting member mounted on a fuel intake port of the engine, the apparatus has a fuel supply for deriving fuel from the fuel tank and pressurizing the fuel and a pressure regulating member which is located between the fuel injecting member and the fuel supply pump and regulates the pressure of fuel to be supplied to the fuel injecting member so as to maintain a constant difference with respect to the intake pressure of the engine. The fuel injecting member is electronically driven by a driving means, so that the engine is supplied with an adequate amount of fuel for the condition of operation of the engine. The fuel pressurizing operation of the fuel supply pump is stopped by a stopping means which is responsive to an electric driving output from the driving means, when the electric driving output assumes a prescribed condition.

The fuel pressurized by the fuel supply pump is regulated in pressure by the pressure regulating member as described above and the resulting surplus fuel from the pressure regulating member is returned to the fuel tank. When the occurrence of a prescribed condition which may cause the stopping of fuel supply to the engine, such as deceleration, engine failure or the like, is detected by the stopping means on the basis of the condition of the electric driving output, the fuel pressurizing operation by the fuel supply pump is stopped by, for example, stopping the drive of the fuel supply pump. Thus, meaningless fuel pressurization can be avoided and no surplus fuel is produced from the pressure regulating member.

The invention will be better understood and other objects and advantages thereof will be more apparent from the following detailed description of preferred embodiments made with reference to the accompanying drawings.

DESCRIPTION OF THE PREFERRED EMBODIMENTS

Figure 1:
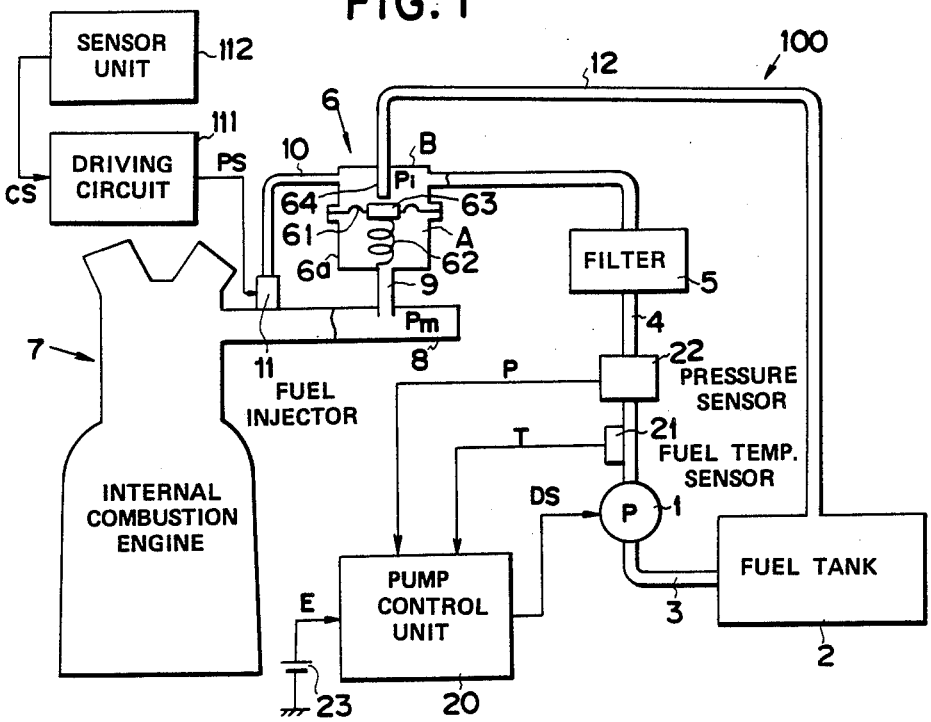
FIG. 1 is a schematic block diagram showing an embodiment of a fuel supplying system according to the present invention, including a sectional view of a fuel regulating valve.

Referring to FIG. 1, a fuel supplying system 100 has an electric fuel pump 1 as a fuel supply pump, which is connected with a fuel tank 2 by means of a fuel passage 3. The fuel in the fuel tank 2 is pumped therefrom and pressurized by the electric fuel pump 1, and the pressurized fuel is supplied to a fuel passage 4. A filter 5 is provided in the course of the fuel passage 4 and sand and the like contained in the fuel is removed by the filter 5. The fuel from the filter 5 is sent to a pressure regulating valve 6.

The pressure regulating valve 6 regulates the pressure of fuel at the outlet of the filter 5 so as to be maintained at a pressure Pi which is always greater than inner pressure Pm of an intake manifold 8 of an internal combustion engine 7 by a prescribed constant value ΔP.

A diaphragm 61 is provided in a casing 6a of the pressure regulating valve 6 and the interior space of the casing 6a is divided into two chambers A and B by the diaphragm 61. The diaphragm 61 is provided with a moving plate 63, which is biased by a spring coil 62 located in the chamber A so as to be pressed onto the opening of a pipe 64 projecting into the chamber B. The chamber A is communicated through a pipe 9 with the interior of the intake manifold 8 and the pressurized fuel passing through the filter 5 is supplied into the chamber B. A part of the fuel from the filter 5 is supplied through a fuel passage 10 to a fuel injector 11 and the remaining fuel is led-out from the chamber B through the pipe 64 as surplus fuel as described later. The surplus fuel from the chamber B is returned through a return passage 12 to the fuel tank 2.

Since the pressure in the chamber A is equal to that in the manifold 8, the position of the moving plate 63 depends upon the pressure in the manifold 8, so that the moving plate 63 approaches and moves away from the opening of the pipe 64 to carry out the desired pressure regulating operation. Thus, the amount of fuel returned to the fuel tank 2 is regulated depending upon the position of the moving plate 63 and the pressure Pi of the fuel supplied from the electric fuel pump 1 can be maintained so as to be greater than the pressure Pm by value ΔP.

The fuel regulated in pressure by the pressure regulating valve 6 is supplied to the fuel injector 11, which is controlled by a pulse signal PS produced from a driving circuit 111 of well-known design. The driving circuit 111 is responsive to a condition signal CS from a sensor unit 112 and showing the operating condition of the engine 7, and produces the pulse signal PS in accordance with the condition signal CS. The condition signal CS may be, for example, an engine speed signal, a signal showing the engine coolant temperature or the like. The fuel injector performs ON/OFF operation in response to the pulse signal PS, so that an adequate fuel quantity is injected into the engine 7 at a desired time.

There is provided a pump control unit 20 for controlling the operation of the electric fuel pump 1 so that it delivers an adequate amount of fuel. For detecting the fuel condition at the output side of the electric fuel pump 1, a fuel temperature sensor 21 and a pressure sensor 22 are attached to the fuel passage 4. The fuel temperature sensor 21 is for detecting the temperature of fuel in the fuel passage 4 and producing a fuel temperature signal T indicating the detection result. The pressure sensor 22 is for detecting the pressure Pi of fuel supplied from the electric fuel pump 1 and producing a pressure signal P indicating the detection result. The fuel temperature signal T and the pressure signal P are applied to the pump control unit 20 to which a voltage signal E representing the level of the terminal voltage Uo of a battery 23 is applied. The required electric power is provided by the battery 23.

In consideration of the level of the terminal voltage Uo, the fuel pressure and the fuel temperature, the pump control unit 20 produces a driving control signal DS for controlling the operation of the electric fuel pump 1 so as to obtain an adequate fuel quantity corresponding to the pressure Pi of the fuel supplied, and the driving control signal DS is applied to an electric driving motor 1*a* (see FIG. 2) of the electric fuel pump 1.

Figure 2:
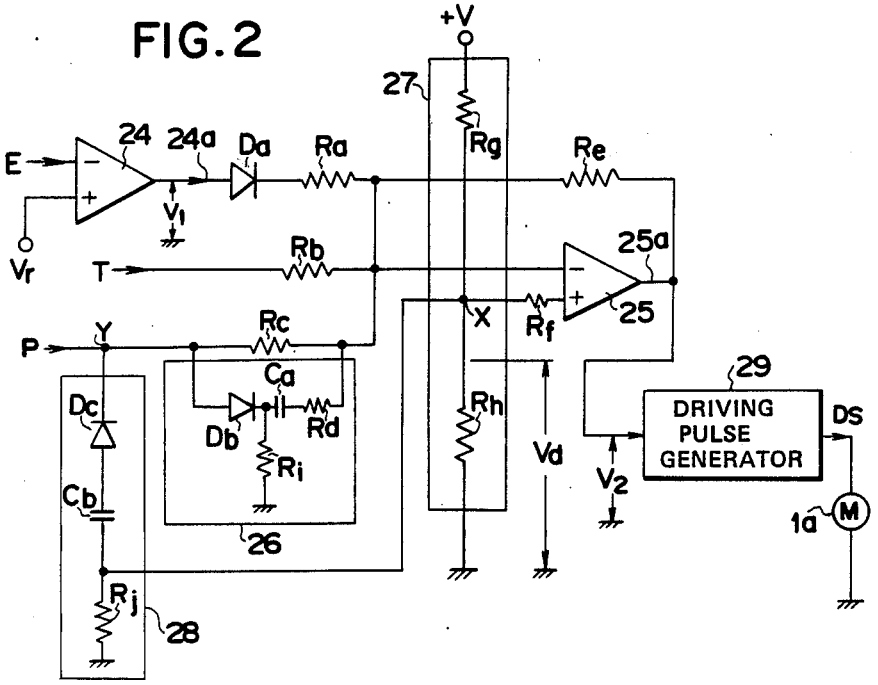
FIG. 2 is a circuit diagram of a pump control unit shown in FIG. 1.

FIG. 2 is a circuit diagram of the pump control unit 20. The voltage signal E is applied to the inverting input terminal of an operational amplifier 24 having a non-inverted input terminal to which a reference voltage Vr of a prescribed constant magnitude is applied, and a first output voltage $V_1$ whose level changes in accordance with the actual level of the terminal voltage of the battery 23 is produced on the output line 24*a* of the operational amplifier 24. The first output voltage $V_1$ is applied through a diode Da and a resistor Ra to the inverting input terminal of another operational amplifier 25.

Figure 3:
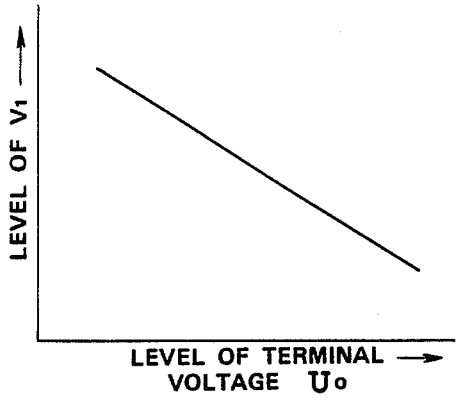
FIGS. 3 to 5 are graphs showing characteristics of the signals in FIG. 2.

FIG. 3 is a graph showing the relationship between the first output voltage $V_1$ and the terminal voltage Uo of the battery 23.

Figure 4:
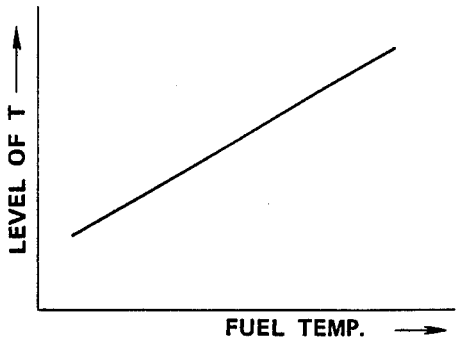

As shown in FIG. 4, the fuel temperature signal T increases in level as the temperature of the fuel increases, and the signal T is applied through a resistor Rb to the inverting input terminal of the operational amplifier 25.

The pressure signal P also increases in level with increase of the pressure Pi, and the signal P is applied through a resistor Rc to the inverting input terminal of the operational amplifier 25. A first differential circuit 26 consisting of a diode Db, a capacitor Ca and resistors Rd and Ri is provided for differentiating the pressure signal P and is connected in parallel with the resistor Rc. Accordingly, in the case where the level of the pressure signal P suddenly changes due to a sudden increase in the pressure Pi, the variation component thereof is applied through the first differential circuit 26 to the inverting input terminal of the operational amplifier 25. In the circuit 26 the resistor Ri serves to form a discharging path for the capacitor Ca.

The non-inverted input terminal of the operational amplifier 25 is connected through a resistor Rf with a voltage dividing circuit 27, which is composed of resistors Rg and Rh and serves to divide a source voltage +V from a stabilized power source (not shown). The resulting divided voltage Vd of the voltage dividing circuit 27 appearing at a connecting point X is applied through the resistor Rf to the non-inverted input terminal of the operational amplifier 25.

The connecting point X is connected through a second differential circuit 28 with an input point Y to which the pressure signal P is applied. The second differential circuit 28 is composed of a diode Dc, a capacitor Cb and a resistor Rj and the differential component of the pressure signal P can be applied through the circuit 28 to the non-inverted input terminal of the operational amplifier 25. Accordingly, in the case where the level of the pressure signal P suddenly changes due to a sudden decrease in the pressure Pi the potential at the connecting point X may be temporarily lowered. In the circuit 28, the resistor Rj serves to form a discharging path for the capacitor Cb.

The output line 25*a* of the operational amplifier 25 is connected through a feedback resistor Re to its inverting input terminal and a second output voltage $V_2$ appearing on the output line 25*a* is applied to a driving pulse generator 29. The driving pulse generator 29 is responsive to the second output voltage $V_2$ and produces the driving control signal DS whose duty cycle is controlled in accordance with the level of the second output voltage $V_2$. The driving control signal DS is applied to the electric motor 1*a*. In this embodiment, the duty cycle increases with decrease in the level of the second output voltage $V_2$ to increase the speed of the electric motor 1*a*.

An explanation of the operation of the circuit shown in FIG. 2 will be given hereinafter.

Figure 5:
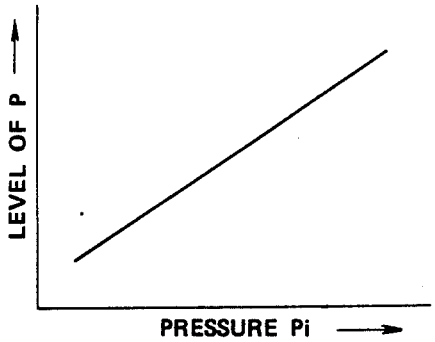
Figure 5:
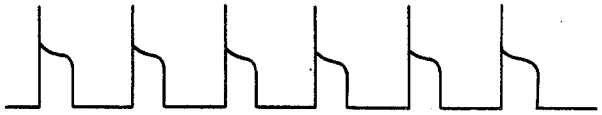
Figure 5:
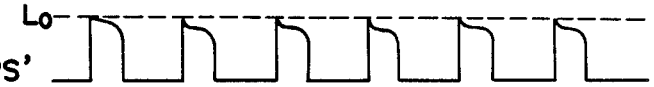
Figure 5:
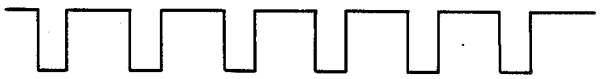

As will be understood from the graphs shown in FIGS. 3 to 5, in the case where the fuel temperature and or the pressure Pi increases, since the level at the inverting input terminal of the operational amplifier 25 is increased, the level of the second output voltage $V_2$ is lowered and the speed of the electric motor 1*a* is increased. That is, when the pressure Pi becomes high with increase of the load of the engine 7, the rotational speed of the electric motor 7*a* is increased so as to obtain an adequate amount of fuel for the increase in pressure Pi mentioned above. Thus, the amount of fuel supplied from the electric fuel pump 1 reaches an appropriate amount for the engine load.

In addition, since the fuel increases in volume when its temperature increases, the amount of fuel supplied substantially decreases. However, in this case, the rotational speed of the electric motor 1*a* increases to compensate for the decrease in supplied fuel quantity. Thus, the amount of fuel supplied from the electric fuel pump 1 increases, preventing the temperature of fuel from increasing. Accordingly, the occurrence of vapor-lock is also effectively suppressed at the same time. In response to the rise/fall of the terminal voltage Uo of the battery 23, the level of the second output voltage $V_2$ is decreased/increased, so that the variation in the rotational speed of the electric motor 1*a* due to the change in the level of the terminal voltage Uo can be cancelled out.

Accordingly, variation in the amount of fuel supplied from the electric fuel pump 1 owing to variation in the level of the terminal voltage Uo of the battery 23 can be suppressed. Furthermore, the amount of fuel supplied is controlled in response to the engine load and the fuel temperature so as to obtain the appropriate fuel quantity for the operating condition of the engine at that time.

In the circuit shown in FIG. 2, where the pressure Pi suddenly increases due to sudden increase in the engine load, a signal corresponding to the sudden increase of the pressure Pi is applied through the first differential circuit 21 to the inverting input terminal of the operational amplifier 25, so that the increase in the fuel quantity supplied from the electric pump 1 will be quickly carried out. On the other hand, where the pressure Pi suddenly decreases because of a sudden decrease in the engine load, the sudden decrease in potential at the input point Y is transmitted through the second differential circuit 28 to the connecting point X, temporarily lowering the potential at X. As a result, further lowering of the fuel pressure Pi can be prevented in the case of a sudden increase in the level of the second output voltage $V_2$. Thus, when the fuel pressure Pi suddenly decreases, the undesired action by which the lowering of the pressure Pi would otherwise be prompted can be effectively prevented, so that stable operation of the electric fuel pump 1 and the electric motor 1*a* can be realized.

According to the apparatus shown in FIG. 1, since the amount of fuel supplied from the electric fuel pump 1 is controlled in response to at least the load condition of the engine, the noise level and power consumption of the pump can be markedly suppressed as compared with the conventional system in which the pump is always operated at its maximum capacity. Furthermore, since a fuel quantity matched to the engine load is provided from the electric fuel pump 1, less amount of fuel is returned through the return passage 12 to the fuel tank 12. As a result, the temperature increase of the fuel in the fuel tank 2 can be effectively suppressed, preventing the occurrence of vapor-lock. Thus, the safety and reliability of the supply of fuel can be ensured.

Although in the embodiment shown in FIG. 1 the pump control unit 20, the fuel temperature sensor 21 and the pressure sensor 22 are separated from the electric fuel pump 1, it is convenient to incorporate the pump control unit 20, the fuel temperature sensor 21 and the pressure sensor 22 into the electric fuel pump 1.

Figure 6:
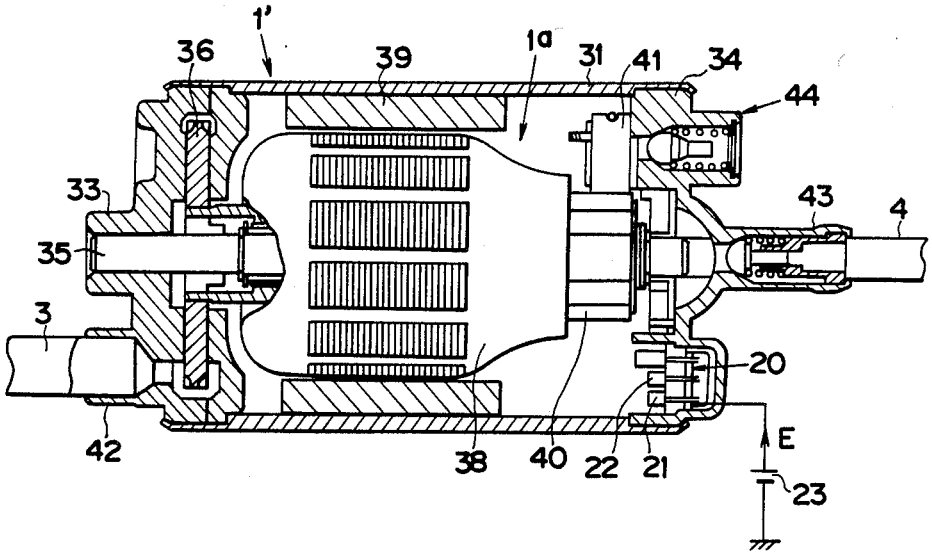
FIG. 6 is a detailed sectional view of a modified electric fuel pump including a pump control unit and sensors.

FIG. 6 is a sectional view showing an electric fuel pump 1' having incorporated therein the pump control unit 20, the fuel temperature sensor 21 and the pressure sensor 22. The electric fuel pump 1' has a cylindrical casing 31 in which the pump control unit 20 shown in FIG. 1 is located. A pair of supporting blocks 33 and 34 are rigidly mounted at the opposite ends of the cylindrical casing 31 and a fixed shaft 35 is supported by the blocks 33 and 34. A turbine 36 is rotatably mounted on the fixed shaft 35 and is rotated by the electric motor 1*a* having a rotor 38. The rotor 38 is rotatably mounted on the fixed shaft 35 so as to be able to integrally rotate together with the turbine 36. The electric motor 1*a* further comprises a cylindrical magnet 39 located on the internal surface of the cylindrical casing 31 and a brush 41 which is in contact with a commutator 40 provided at the end portion of the rotor 38. When the driving current is supplied through the brush to a rotor coil (not shown) wound on the rotor 38, the rotor 38 rotates in a predetermined direction. As a result, the turbine 36 rotates to pressurize fuel supplied through the fuel passage 3 and an input port 42 defined in the supporting block 33, and the pressurized fuel is transmitted to the fuel passage 4 through an output port 43 defined in the supporting block 34. The reference numeral 44 designates a relief valve which opens when the inner pressure of the cylindrical casing 31 has reached a predetermined level, in order to lower the inner pressure. The fuel issuing from the relief valve 44 is returned to the fuel tank 2.

The fuel temperature sensor 21 and the pressure sensor 22, whose functions have been fully described in the foregoing, are fixed on the pump control unit 20 by a suitable means, and the fuel temperature signal T and the pressure signal P are applied to the pump control unit 20 similarly to the case of the system 100 shown in FIG. 1.

Direct current electric power is supplied to the pump control unit 20 from the battery 23 which is located outside of the motor 1*a*, and the voltage signal E is applied to the pump control unit 20. Since the operation of the pump control unit 20 is the same as that shown in FIGS. 1 and 2 no explanation thereof will be given here.

Figure 7:
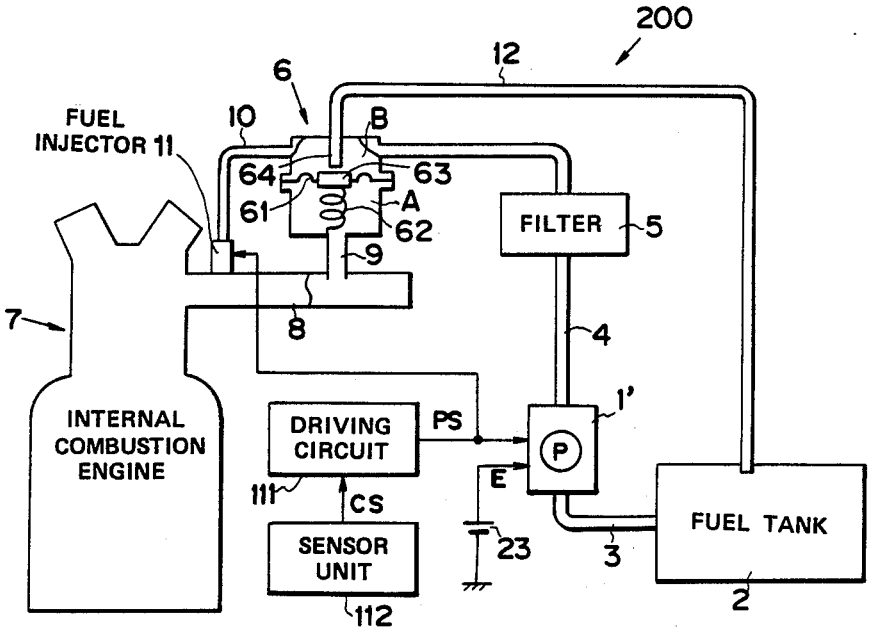
FIG. 7 is a schematic block diagram showing another embodiment of a fuel supplying system according to the present invention.

FIG. 7 is a block diagram showing another embodiment according to the present invention. The fuel supplying system 200 of the embodiment is different from the fuel supplying system 100 shown in FIG. 1 in that its electric fuel pump 1' is the modified one shown in FIG. 6 and the operation of the fuel pump 1' can be controlled in accordance with the driving condition of the fuel injector 11. Accordingly, in FIG. 7 components corresponding to those in the system shown in FIG. 1 are designated by identical reference numerals and symbols, and no explanation of those components will be given here.

Similarly to what is shown in FIG. 6, the electric fuel pump 1' has incorporated therein, a pump control unit 20' for controlling the electric fuel pump 1', the fuel temperature sensor 21 and the pressure sensor 22.

Figure 8:
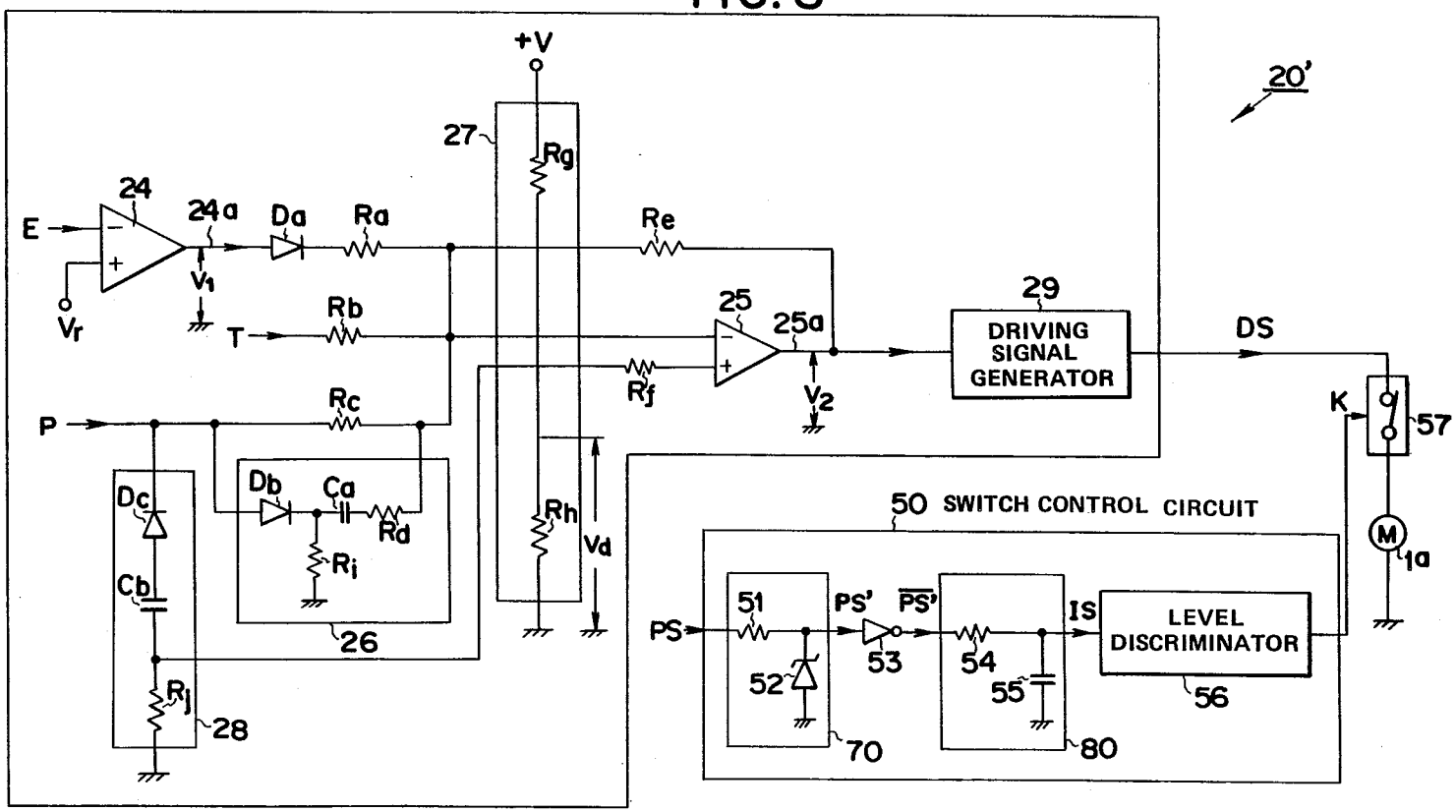
FIG. 8 is a circuit diagram of a pump control unit using in the system shown in FIG. 7, and FIGS. 9A to 9C are waveforms of signals in a switch control circuit shown in FIG. 8.

FIG. 8 is a circuit diagram of the pump control circuit 20' located in the electric fuel pump 1' shown in FIG. 7. The circuit portion enclosed by a broken line is the same as that shown in FIG. 2 except that the driving control signal DS is applied to the electric motor 1*a* through a switch 57. Therefore, this portion will not be further explained here.

A switch control circuit 50 is provided for controlling the ON/OFF condition of the switch 57 in response to the pulse signal PS from the driving circuit 111. More specifically, the switch control circuit 50 discriminates on the basis of the condition of the pulse signal PS whether or not the fuel injecting operation is carried out by the fuel injector 11, and the discrimination signal K is produced as a signal indicating the discrimination result preformed by the switch control circuit 50. The level of the discrimination signal K becomes high when the fuel injecting operation is carried out by the fuel injector 11 and the level of the discrimination signal K becomes low when it is not. The switch 57 is responsive to the discrimination signal K, and is opened for its high level and is closed for its low level.

A detailed explanation of the switch control circuit 50 will be given hereinafter.

The waveform shown in FIG. 9A is one example of the waveform of the pulse signal PS, which is applied to a limiting circuit 70 composed of a resistor 51 and a zener diode 52. The peak level of the pulse signal PS is limited to less than a predetermined level Lo by the limiting circuit 70, and the limited pulse signal PS' has a peak level Lo as shown in FIG. 9B.

The limited pulse signal PS' is inverted by an inverter 25 and the resulting signal is applied as an inverted pulse signal PS' shown in FIG. 9C to an integration circuit 80 composed of a resistor 54 and a capacitor 55. The inverted pulse signal PS' is integrated by the integration circuit 80 and the resulting signal IS is applied to a level discriminator 56 from which the discrimination signal K is produced. The level discriminator 56 causes the level of the discrimination signal K to become high when the level of the signal IS is more than a prescribed reference level, whereas it causes it to become low when the level of the signal IS is not more than the prescribed reference level.

With this circuit arrangement, the level of the signal IS becomes high as the duty cycle of the driving control pulse DS becomes less to reduce the amount of fuel injected from the fuel injector 11. The level of the discrimination signal K becomes high when the amount of fuel injected has reached a predetermined level, which may be zero, whereby the switch 57 is opened to stop the operation of the electric motor 1*a*.

With the pump control circuit 20' shown in FIG. 8, the control operation for the electric fuel pump 1' is the same as that in the system shown in FIG. 1 in the case where the switch 27 is closed. On the other hand, when the switch 27 is opened, the fuel supply operation by the electric fuel pump 1' stops.

As described above, since the fuel supply from the electric fuel pump 1' is stopped in the case of no injection condition of the fuel injector 11, unnecessary circulating operation of fuel can be avoided, preventing waste of electric power and increase in fuel temperature.

We claim:

1. A fuel supplying system in which fuel in a fuel supply means is pressurized by means of a fuel supply pump and is supplied to an internal combustion engine; said system comprising:

a pressure regulating member for regulating the pressure of pressurized fuel derived from said fuel supply pump by returning surplus fuel to said fuel supply means so as to maintain the difference between an output fuel pressure of said fuel supply pump and an inner pressure of an intake manifold of said engine at a prescribed constant value;

a fuel injecting member for injecting into said engine the fuel regulated in pressure by said pressure regulating member;

a sensing means for sensing the pressure of fuel delivered by said fuel supply pump, said sensing means being incorporated in said fuel supply pump; and, a control means incorporated in said fuel supply pump and responsive to said sensing means for controlling the amount of fuel delivered by said fuel supply pump in accordance with the pressure of fuel delivered from said fuel supply pump so that the amount of surplus fuel produced by the pressure regulating operation of said pressure regulating member and returned to the fuel supply means is effectively reduced.

2. A system as claimed in claim 1 wherein said sensing means is a transducing means for producing an electric signal corresponding to the pressure of fuel delivered from said fuel supply pump, and said controlling means is an electric circuit means responsive to said electric signal for controlling the rotational speed of said fuel supply pump.

3. A system as claimed in claim 1 further comprising a driving means for producing a driving signal for electronically driving said fuel injecting member so as to provide said engine with an adequate amount of fuel for operating said engine.

4. A system as claimed in claim 1 wherein said pressure regulating member adjusts the amount of fuel returned to said fuel supply means in response to the intake pressure, whereby the pressure of fuel supplied to said fuel injecting member is adjusted.

5. A system as claimed in claim 1 wherein said pressure regulating member has a housing which has an inlet portion and an outlet portion, a return pipe whose opening is located in the housing, and a regulator which cooperates with the opening to adjust the amount of fuel returned through the return pipe in response to the intake pressure.

6. A system as claimed in claim 2 wherein said controlling means has a first circuit means responsive to said electric signal for producing an output signal relating to said electric signal, and a driving signal generator means responsive to the output signal for producing a driving control signal by which the rotational speed of said fuel supply pump is controlled so as to increase/decrease in correspondence to the increase/decrease of the pressure of fuel delivered by said fuel supply pump.

7. A system as claimed in claim 6 wherein said controlling means further comprises a first differential circuit which is responsive to sudden increasing change in said electric signal and provides said first circuit means with a signal of a high level corresponding to the sudden increasing change, whereby response characteristics of said controlling means are improved.

8. A system as claimed in claim 2 wherein said controlling means further comprises a second differential circuit which is responsive to sudden decreasing change in said electric signal and provides said first circuit means with a signal of a high level corresponding to the sudden decreasing change, whereby response characteristics of said controlling means is improved.

9. A system as claimed in claim 1, further comprising a driving means for electronically driving said fuel injecting member so as to provide said engine with an adequate amount of fuel for operating said engine.

10. A system as claimed in claim 1, further comprising a driving means for producing a driving signal for electronically driving said fuel injecting member so as to provide said engine with an adequate amount of fuel for operating said engine, and means responsive to said driving signal for stopping the pressurizing operation of the fuel supply pump when the amount of fuel injected from said fuel injecting member to said engine is zero.

11. A system as claimed in claim 1, wherein said control means and said sensing means are incorporated into said fuel supply pump.

12. A system as claimed in claim 20, wherein said fuel supply pump comprises a casing having an input port for receiving fuel from said fuel supply means and an output port for providing pressurized fuel to said fuel regulating member, and wherein said sensing means is incorporated in said casing to detect the pressure of said pressurized fuel at the output port of said casing.

* * * * *

UNITED STATES PATENT AND TRADEMARK OFFICE

CERTIFICATE OF CORRECTION

PATENT NO. : 4,920,942

DATED : May 1, 1990

INVENTOR(S) : Fujimori, et al.

It is certified that error appears in the above-identified patent and that said Letters Patent is hereby corrected as shown below:

Claim 11, delete this entire claim.

Claim 12, change number of claim from "12" to --11--; and in line 1, change "20" to --1--.

Signed and Sealed this

Thirteenth Day of August, 1991

*Attest:*

HARRY F. MANBECK, JR.

*Attesting Officer*

*Commissioner of Patents and Trademarks*

US004920924B1

REEXAMINATION CERTIFICATE (2236th)

United States Patent [19]

[11] B1 4,920,924

Abdulally et al.

[45] Certificate Issued Mar. 1, 1994

[54] FLUIDIZED BED STEAM GENERATING SYSTEM INCLUDING A STEAM COOLED CYCLONE SEPARATOR

[75] Inventors: Iqbal F. Abdulally, Randolph; Alfred S. Touma, West Caldwell; Peter Bartkowiak, Denville, all of N.J.

[73] Assignee: Foster Wheeler Energy Corporation, Clinton, N.J.

Reexamination Request:
No. 90/002,795, Jul. 27, 1992

Reexamination Certificate for:

| | |
|---|---|
| Patent No.: | **4,920,924** |
| Issued: | **May 1, 1990** |
| Appl. No.: | **395,865** |
| Filed: | **Aug. 18, 1989** |

[51] Int. Cl.[5] ..... F22B 1/00

[52] U.S. Cl. ..... 122/4 D; 110/245; 110/216

[58] Field of Search ..... 122/4 D; 110/245, 216; 431/7, 170

[56] References Cited

U.S. PATENT DOCUMENTS

| | | | |
|---|---|---|---|
| 1,890,170 | 7/1925 | Van Brunt . | |
| 2,437,294 | 3/1948 | Dalin . | |
| 2,800,974 | 7/1957 | Gilman et al. . | |
| 2,937,141 | 5/1960 | Helwig . | |
| 2,995,807 | 8/1961 | Gibbs . | |
| 3,327,456 | 6/1967 | Guber et al. . | |
| 3,470,678 | 10/1969 | Clark et al. . | |
| 3,554,706 | 1/1971 | Henderson . | |
| 3,710,857 | 1/1973 | Meyer et al. . | |
| 3,732,920 | 5/1973 | Kimmel . | |
| 4,295,343 | 10/1981 | Izumi . | |
| 4,442,797 | 4/1984 | Strohmeyer, Jr. . | |
| 4,699,068 | 10/1987 | Engstrom | 122/4 D |
| 4,708,092 | 11/1987 | Engstrom | 110/245 |
| 4,713,098 | 12/1987 | Idvorian et al. . | |
| 4,732,113 | 3/1988 | Engstrom | 122/4 D |
| 4,746,337 | 5/1988 | Magol et al. . | |
| 4,755,134 | 7/1988 | Engstrom et al. | 110/245 |
| 4,813,380 | 3/1989 | Engstrom | 122/4 D |
| 4,880,450 | 11/1989 | Magol et al. . | |
| 4,904,286 | 2/1990 | Magol et al. . | |
| 4,913,711 | 4/1990 | Stewart . | |
| 4,944,250 | 7/1990 | Seshamani . | |
| 4,951,612 | 8/1990 | Gorzegno . | |

FOREIGN PATENT DOCUMENTS

| | | |
|---|---|---|
| 0298671 | 1/1989 | European Pat. Off. . |
| 437124 | 2/1985 | Sweden . |
| 581426 | 10/1946 | United Kingdom . |
| 587240 | 4/1947 | United Kingdom . |

*Primary Examiner*—Henry C. Yuen

[57] ABSTRACT

A fluidized bed stream generating system in which a cyclone separator is disposed between the furnace section and heat recovery area of a steam generating system. The walls of the cyclone separator are provided with tubes which receive fluid from the steam drum. The fluid is passed through the walls of the separator to cool same before being passed to the heat recovery area.

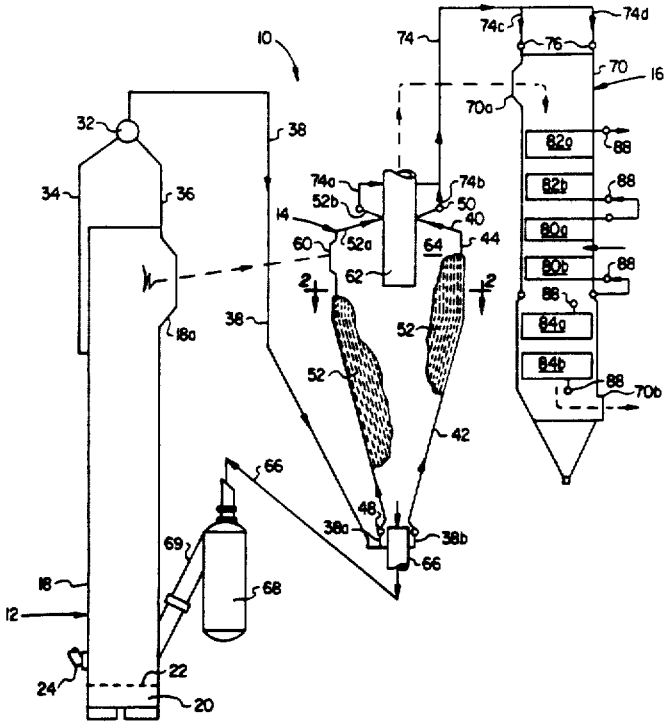

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7-9, 12-13 is confirmed.

Claims 1-6, 10-11 are cancelled.

* * * * *